United States Patent [19]

Silverstrand

[11] 4,300,659

[45] Nov. 17, 1981

[54] FOUR-POST HOIST

[76] Inventor: Thomas R. Silverstrand, 1310 N. 20th St., Lincoln, Nebr. 68503

[21] Appl. No.: 130,996

[22] Filed: Mar. 17, 1980

[51] Int. Cl.[3] ..... B66F 7/00

[52] U.S. Cl. ..... 187/8.59; 294/82 AH

[58] Field of Search ..... 294/82 AH; 254/45, 46, 254/47, 89 H; 269/58, 59, 60; 187/8.59, 8.41, 8.75

[56] References Cited

U.S. PATENT DOCUMENTS

| | | | |
|---|---|---|---|
| 1,212,646 | 1/1917 | King | 187/8.59 |
| 2,800,200 | 7/1957 | Wallace | 187/8.59 |
| 3,395,777 | 8/1968 | Rodosta | 187/8.59 |
| 3,985,207 | 10/1976 | Petit | 187/8.59 |
| 4,212,449 | 7/1980 | Tsujimuro | 187/8.59 |

*Primary Examiner*—James B. Marbert

*Attorney, Agent, or Firm*—Vincent L. Carney

[57] ABSTRACT

A hoist for lifting vehicles such as automobiles and trucks includes four vertical posts, each having flanges defining vertically extending channels. A lifting frame is disposed within the area defined by the posts and includes a slidable connection with each of the posts. The lifting frame is adapted to support a vehicle and thereafter to raise and lower the vehicle. The upper portions of the posts are connected by a pair of braces. Hydraulic cylinders are provided to raise and lower the lifting frame, one cylinder being connected to each corner of the lifting frame. Two hydraulic cylinders are secured to each brace and are connected to opposite ends of the lifting frame by a flexible connection in the form of a chain. Each chain is reeved about a pulley secured to one of the posts at or near the upper end of the post. The invention makes substantial use of H-beam and I-beam construction to provide an inexpensive, rapidly assembled hoist having great strength and versatility.

18 Claims, 10 Drawing Figures

FOUR-POST HOIST

BACKGROUND OF THE INVENTION

1. Field of the Invention

The invention relates to hoists for lifting objects such as automobiles and trucks and, more particularly, to a hoist employing I-beam construction to a substantial extent, individual drive means for lifting the corners of a lifting frame, and other novel features.

2. Description of the Prior Art

Above-ground hoists adapted for lifting vehicles such as automobiles, trucks, and so forth have been known for some time. These devices typically take the form of a plurality of vertically oriented posts to which a lifting frame is secured in sliding relationship. The lifting frame is configured such that a vehicle can be driven onto or over the lifting frame and, upon raising the lifting frame, the vehicle will be lifted. Various types of driving mechanisms have been provided to raise and lower the lifting frame, such arrangements generally being used in the form of vertically extending threaded rods carried by the posts. Each rod carries a nut secured to a corner of the lifting frame such that, upon rotation of the rod, the nut and hence the lifting frame is raised or lowered as desired. Other driving arrangements for the lifting frame include an endless cable or chain reeved about pulleys or sprockets connected to driving gear arrangements located at the corners of the lifting frame. At least one other known driving arrangement employs vertically oriented hydraulic cylinders secured to the lifting frame to raise and lower the lifting frame.

The aforementioned hoists, although functioning more or less effectively to raise and lower a vehicle, still fail to address certain problems. One problem not adequately addressed by prior hoists is that of providing a strong structure, while at the same time keeping the structure relatively inexpensive and easy to assemble. In certain cases portions of the lifting frame are securely yet slidably connected to the posts such that, upon vertical motion of the lifting frame, the posts will be connected to each other rigidly. A problem with this approach is that specially formed interlocking parts are required to properly mate the lifting frame and the posts, and wear of these parts can adversely affect the strength and efficiency of the hoist. It is desirable that the lifting frame be slidably connected to the posts with a minimum of specially formed, carefully sized parts without sacrificing the stability of the hoist.

Another problem not adequately addressed by prior art devices is the technique by which the lifting frame is moved vertically. Generally speaking, the prior art endless cable and hydraulic cylinder arrangements have been unduly expensive and difficult to assemble. Moreover, a failure of an endless chain or cable can result in the entire lifting frame falling or becoming disabled.

Yet another consideration not adequately addressed by prior art hoists relates to the construction of the lifting frame and the techniques by which it can be adjusted to fit different vehicles. Most prior lifting frames engage the frame of the vehicle, rather than the wheels of the vehicle. In other words, the vehicle is driven over the frame and the lifting frame is raised until the body of the vehicle is contacted. Such an arrangement can be a drawback in those instances where portions of the vehicle's engine, transmission, exhaust system, and so forth must be serviced. This is because the lifting frame can obstruct the parts needing repair and, accordingly, the repair work can be made unnecessarily difficult. Although it is known to provide a lifting frame having runways upon which the wheels of a vehicle can be supported, such lifting frames have been difficult to manufacture and adjust. Moreover, runway-type-lifting frames have not included safety systems to prevent the lifting frame from becoming excessively unbalanced.

SUMMARY OF THE INVENTION

The present invention overcomes the foregoing and other drawbacks of prior art proposals by providing a new and improved four-post hoist having desirable qualities of manufacturing expense, simplicity of operation, strength and reliability. In accordance with the preferred practice of the present invention, the hoist includes four vertically extending posts, the posts defining a quadrilateral with one post being placed at each corner of the quadrilateral. A lifting frame having portions positioned within the quadrilateral and upon which a vehicle can be driven is vertically slidably connected to each of the posts. In order to stabilize the hoist and provide a mounting position for drive means such as hydraulic cylinders to raise and lower the lifting frame, first and second braces extend between and connect opposed pairs of posts. The braces, when viewed from above, are parallel to each other and lie generally along the boundary of the quadrilateral defined by the posts, the braces being connected to the posts toward the upper end of the posts.

A separate drive means is provided for each corner of the lifting frame and is connected to each corner of the frame by means of a flexible connection. Two drive means are secured to one of the braces, and two drive means are secured to the other brace. In preferred form, the drive means comprise hydraulic cylinders, and the flexible connections comprise chains passing over pulleys located at or near the upper end of the posts. For maximum strength and simplicity of construction, the braces lie in a horizontal plane and the hydraulic cylinders include actuating rods which are movable in a horizontal plane. A plurality of sliding blocks are connected to the braces, one sliding block being provided for each hydraulic cylinder. The blocks are slidable along the braces and support the ends of the actuating rods.

The strength and simplicity of the hoist is greatly enhanced by the substantial use of H-beam and I-beam construction. Each of the vertically extending posts is in the form of an H-beam, with the flanges of the H-beam defining vertically extending channels. The lifting frame includes a pair of crosspieces formed of I-beams, the crosspieces when viewed from above being parallel with each other and extending between and coming in contact with channels of separate pairs of posts. The lifting frame also includes a pair of generally parallel runways formed of H-beams, the runways resting atop and being carried by the crosspieces, the runways when viewed from above being substantially perpendicular to the crosspieces. The braces also are in the form of I-beams. The portions of the crosspieces extending within the confines of the channels are provided with relatively friction-free surfaces engageable with the channels to constrain the crosspieces and yet permit relatively friction-free vertical movement of the crosspieces along the posts. The sliding blocks also include relatively friction-free surfaces at their interface with the braces. The runways are adjustable to accommodate differently sized vehicles, and stops secured to the crosspieces prevent the lifting frame from becoming excessively unbalanced upon adjustment of runway positions.

The invention additionally includes inexpensive, rapidly assembled pulleys especially effective for changing the direction of force applied by a chain. Each pulley comprises a first pair of disc-like plates, each plate having an opening at its center. A second pair of disc-like plates have an outer diameter smaller than the outer diameter of the first pair of plates also include an opening at their center. The second pair of plates, in use, have their openings positioned coaxially with respect to the openings of the first pair of plates, and the second pair of plates are compressed between the first pair of plates. A third disc-like plate has an opening at its center and has an outer diameter smaller than the outer diameter of the second pair of plates. In use, the third plate is compressed between the second pair of plates and has its central opening positioned coaxially with respect to the openings in the first and second pair of plates. By this construction, and by appropriate selection of the thickness of the plates, every other link of a chain in contact with the pulley is supported on the outer diameter of the second pair of plates and the remaining links of the chain in contact with the pulley engage the outer diameter of the third plate. Maximum contact with the chain is provided, and yet minimum resistance to chain movement exists. A chain passing over the pulley cannot become twisted, the chain is not unnecessarily stressed, and the safety and efficiency of the hoist is increased.

The foregoing and other features and advantages, and a fuller understanding of the invention, may be had by referring to the following description and claims, taken in conjunction with the accompanying drawings.

DESCRIPTION OF THE PREFERRED EMBODIMENT

Figure 1:
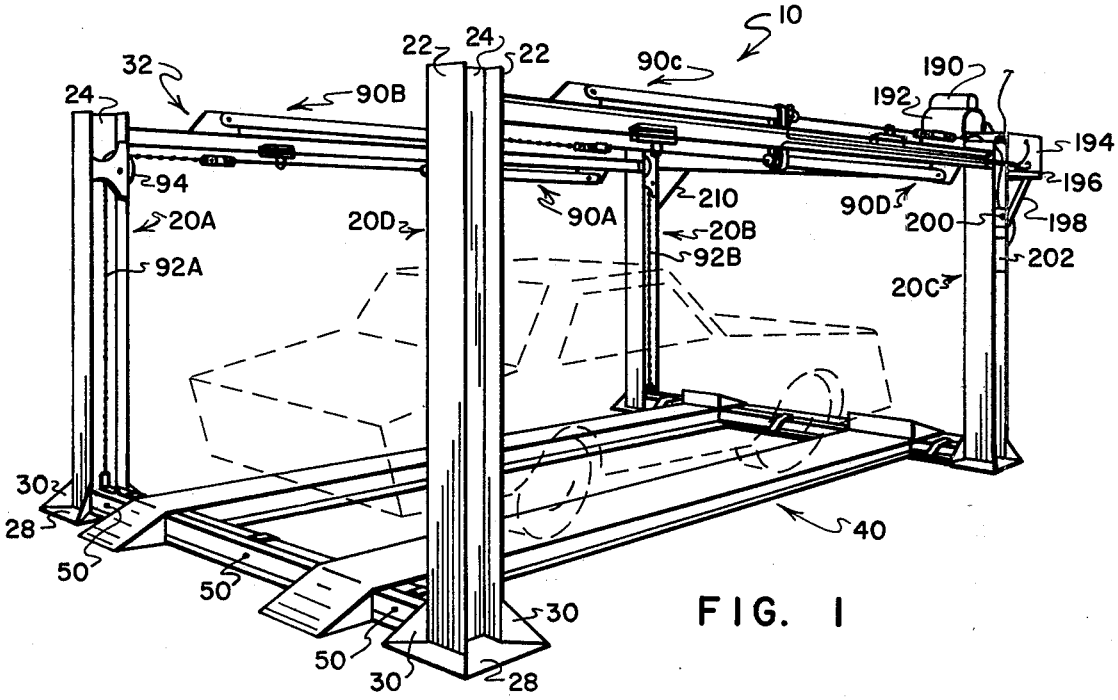
FIG. 1 is a perspective view of a four-post hoist according to the invention in which a lifting frame is resting upon the ground and a vehicle is shown in dotted lines in position atop the lifting frame.
Figure 2:
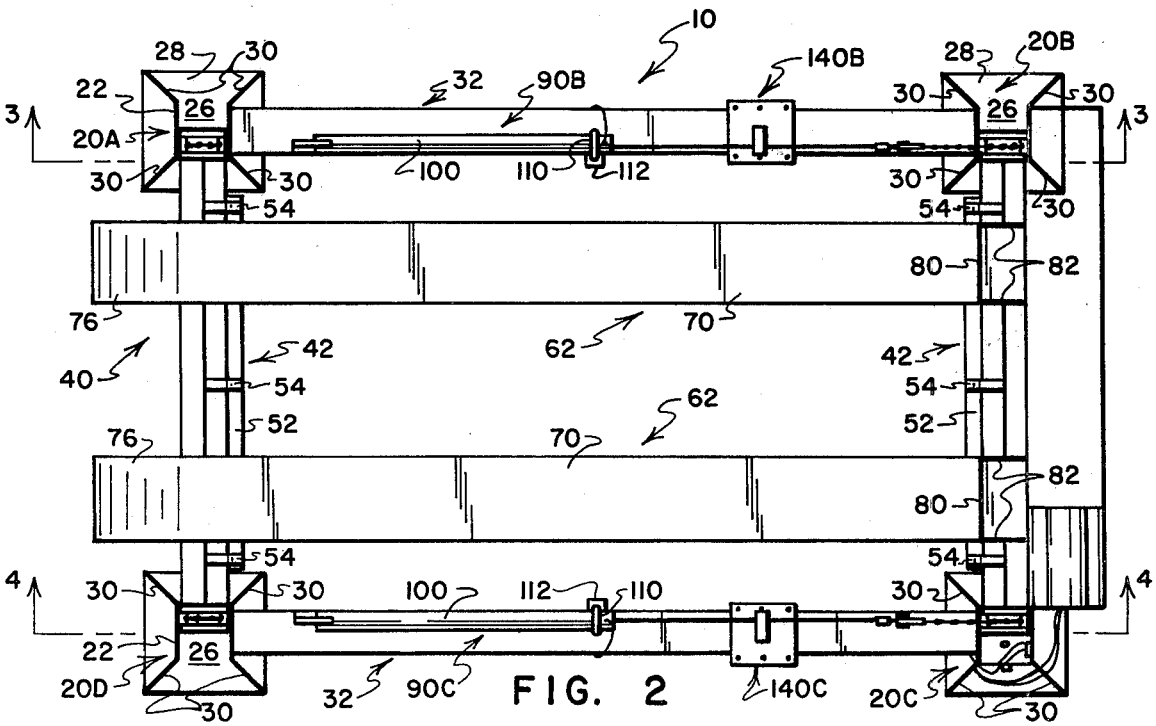
FIG. 2 is a plan view of the hoist of FIG. 1, showing the relationship between the lifting frame and the posts.
Figure 3:
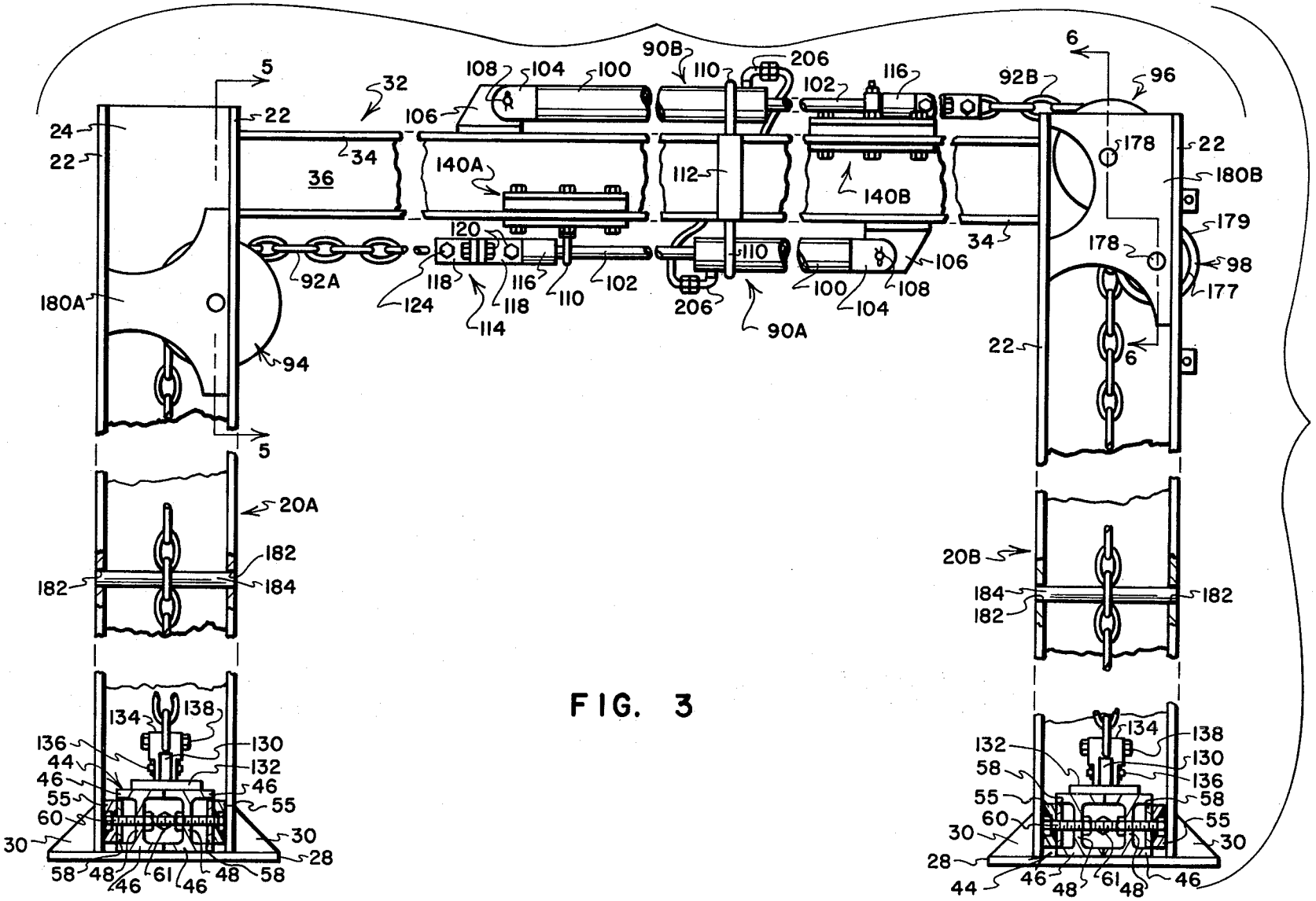
FIG. 3 is a view taken along a plane indicated by line 3—3 in FIG. 2.
Figure 4:
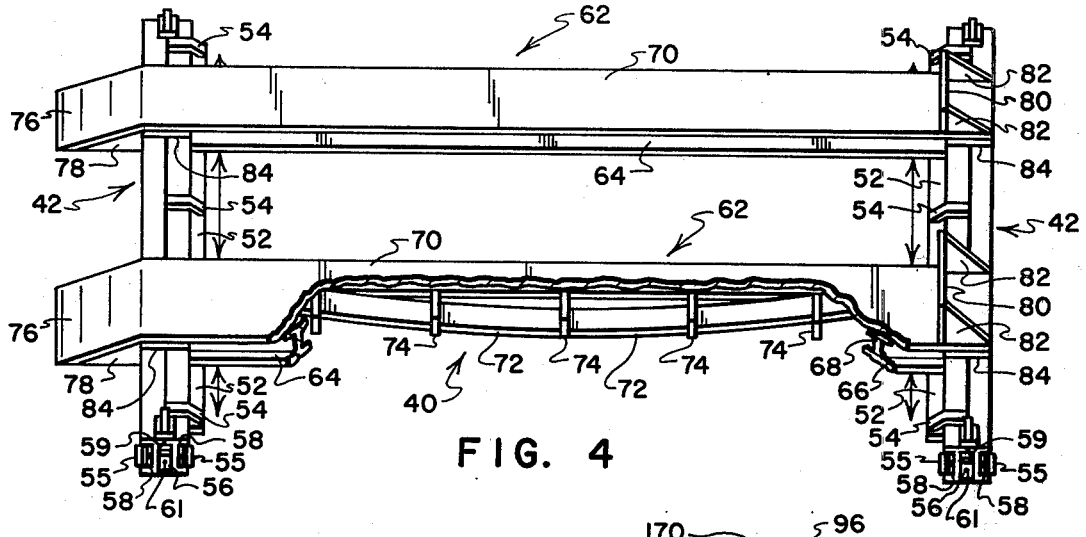
FIG. 4 is a perspective view of the lifting frame according to the invention, with certain portions broken away and removed for clarity.

Referring to FIGS. 1-3, a four-post hoist particularly suited for lifting vehicles such as automobiles, trucks, and so forth is indicated generally by the numeral 10. The hoist 10 includes four, substantially identical, vertically extending posts 20A-20D. The posts 20A-20D define a quadrilateral, with one post being placed at each corner of the quadrilateral. In preferred form, the quadrilateral is a rectangle, with the longer dimension of the rectangle being defined by the posts 20A-20B and 20C-20D. Each post 20A-20D essentially is an H-beam having four flanges 22 and a connecting web 24 which define a pair of vertically extending channels 26. Each post rests upon a pad 28 and is stabilized in position there by gussets 30. The posts 20A-20D are arranged such that channels 26 of the posts 20A-20D and 20B-20C face each other.

The upper ends of the posts 20A-20B and 20C-20D are connected by horizontally extending braces 32 which are secured to the posts 20A-20D near their upper end. The braces 32, when viewed from above, are parallel with each other. Each brace 32 is in the form of an H-beam having flanges 34 and a connecting web 36.

A lifting frame 40 is positioned within the quadrilateral defined by the posts 20A-20D and is slidably connected to the posts 20A-20D such that vertical movement along the posts is possible. The lifting frame 40 includes a pair of parallel crosspieces 42 extending between, and coming into contact with, the channels 26 of posts 20A-20D and 20B-20C. Each crosspiece 42 is formed of a pair of I-beams 44, each having flanges 46 and a connecting web 48. The I-beams 44 are secured to each other by bolted fasteners 50 and a rectangular plate 52 is secured to the bottom of the I-beams 44 to the bottom flanges 46. Safety stops 54 in the form of small, downwardly bent tabs are secured to the plate 52 and to the top of one of the beams 44 at locations spaced along the length of the crosspieces 42. One safety stop 54 is placed at approximately the center of each crosspiece 52, and other safety stops 54 are placed toward the ends of crosspiece 42. The safety stops 54 prevent the lifting frame 40 from becoming excessively unbalanced, as will be described, and provide double safety connections because they are welded to the plates 52 and the beams 44.

In order to constrain the ends of the crosspieces 42 and yet permit them to slide along the posts 20A-20D with relatively little frictional resistance, side guide pads 55 and end guide pads 56 are secured on opposite sides of the crosspieces 42 near each end. In the embodiment illustrated, the guide pads 55, 56 are in the form of nylon blocks. The guide pads 55, 56 thus are relatively friction-free, and permit the crosspieces to tightly engage the flanges 22 and webs 24 of the posts 20A-20D respectively, and yet slide relatively easily with respect to the posts 20A-20D. Each guide pad 55 is secured to a support 58 and each guide pad 56 is secured to a support 59. Each guide pad 55 and its associated support 58 are secured to the webs 48 by means of bolted fasteners 60. The supports 59 are welded to the ends of the beams 44 and the guide pads 56 are secured to the supports 59 by bolted fasteners 61. The bolted fasteners 60, 61 are countersunk within the guide pads 55, 56 so that only the guide pads 55, 56, and not the ends of the fasteners 60, 61, will come into contact with the flanges 22 and web 24 of the posts 20-20D. The foregoing construction wherein the I-beams 44 are bolted to each other, the rectangular plate 52 is welded to the bottom of the I-beams 44, the safety stops 54 are welded to the plate 52 and the beams 44, and the guide pad supports 58, 59 are bolted and welded to the beams 44, provides an exceedingly strong, yet inexpensive structure capable of resisting great loads.

The lifting frame 40 also includes a pair of runways 62 adapted to be driven upon by a vehicle (as shown in FIG. 1 by the dotted lines) such that the wheels of the vehicle are supported. The runways 62 are disposed substantially perpendicular to the crosspieces 42 and, when viewed from above (FIG. 2), the runways 62 are parallel to the braces 32. The runways 62 employ H-beams to produce an inexpensive, strong structure. Each runway 62 includes a pair of H-beams 64 positioned parallel with each other. The H-beams 64 are of a length slightly less than the distance by which the crosspieces 42 are spaced. Each of the H-beams 64 includes flanges 66 and a connecting web 68. A rectangular plate 70 lies atop and is secured to the upper flanges 66 of the H-beams 64. In order to strengthen the assembly and prevent the runways 62 from sagging, inclined trusses 72 having a number of vertically extending plates 74 secured thereto are positioned between the H-beams 64. The plates 74 are secured in place by welding to the underside of the plate 70.

An approach plate 76 is secured to one end of the rectangular plate 70 and is stabilized in position there by gussets 78. The approach plate 76 and the gussets 78 define an inclined ramp to facilitate driving a vehicle onto and off of the runways 62. The approach plates 76 are secured to the runways 62 at the end of the runway 62 closest to the crosspiece 42 extending between the posts 20A–20D.

A tire stop 80 in the form of a vertically extending plate is secured to the rectangular plate 70 immediately above the crosspiece 42 extending between the posts 20B–20C. The plate 80 is securely held in position by gussets 82. At that point where the rectangular plate 70 extends over the upper surface of the rectangular plates 52, skids 84 in the form of rectangular plates are secured to the underside of the rectangular plate 70. In accordance with the foregoing construction, the runways 62 are quite strong, and sagging or twisting of the runways 62 largely is eliminated. The skids 84 strengthen the plate 70 and permit the runways 62 to be moved toward or away from each other to accomodate vehicles having different spacings between wheels. The safety stops 54 limit the lateral extent to which the runways 62 can be moved, thereby preventing the lifting frame 40 from becoming excessively unbalanced.

In order to raise and lower the lifting frame 40, individual drive means 90A–90D are provided for each corner of the lifting frame 40. The drive means 90A is associated with the post 20A, the drive means 90B is associated with the post 20B, and so forth. Each of the drive means 90A–90D is connected to a separate corner of the lifting frame 40 by a flexible connection 92A–92D in the form of a chain. The chains 92A, 92D are reeved about pulleys 94 secured to the posts 20A, 20D at or near the upper end of the posts 20A, 20D. The chains 92B, 92C are reeved about pulleys 96, 98 secured to the posts 20B, 20C at or near the upper end of the posts 20B, 20C. The pulleys 96 carry most of the load imposed by the chains 92B, 92C, while the pulleys 98 are idler pulleys which control the axial location of the chains 92B, 92C with respect to the posts 20B, 20C.

Each of the drive means 90A–90D is in the form of a hydraulic cylinder 100. The cylinders 100 include actuating rods 102 which are movable in a horizontal plane parallel to the flanges 34 of the braces 32. One end of the cylinder 100 includes a clevis 104. Pull blocks 106 are secured to the flange 34 of the braces 32 at spaced locations and provide an anchor for the cylinders 100. Each clevis 104 is secured to a pull block 106 by means of a pin 108. The cylinders 100 are also secured in place on the braces 32 by means of U-bolts 110 which pass through openings in the flanges 34 and which also are supported in place on the braces 32 by means of an offset support 112 connecting upper and lower flanges 34.

An adjustment mechanism 114 is secured to each actuating rod 102 to provide a means to remove slack in the chains 92A–92D and to properly orient the lifting frame 40. The adjustment mechanism 114 includes a threaded connection 116 secured to the end of the rod 102. Two pairs of angle sections 118 are connected to each other and to the connection 116 by bolted fasteners 120. The chains 92A–92D are secured to one pair of the angle sections 118 by means of bolted fasteners 122.

The other end of each chain 92A–92D is secured to an appropriate end of the crosspieces 42 by means of a pull block 130 secured atop a plate 132 which, in turn, is secured atop the upper flanges 46. Another angle section pair 134 defines, in effect, a clevis secured to the pull block 130 by means of a pin 136. The angle section pair 134 is held together by a bolted fastener 138. The bolted fastener 138 also connects one of the chains 92A–92D to the angle section pair 134. By this construction, each end of the crosspieces 42 is connected to an actuating rod 102, and upon adjustment of the adjusting mechanisms 114 during final assembly, the position of the lifting frame 40 with respect to the posts 20A–20D can be adjusted as desired.

Figure 7A:
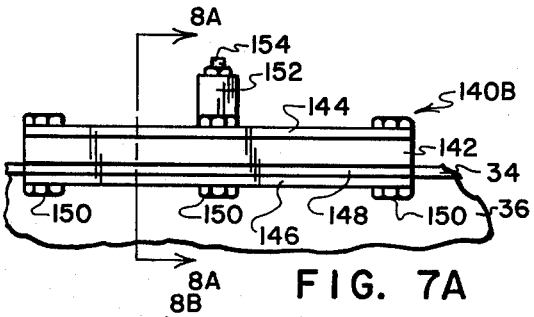
FIG. 7A is an enlarged view of an upper slide block as illustrated in FIG. 3.
Figure 8A:
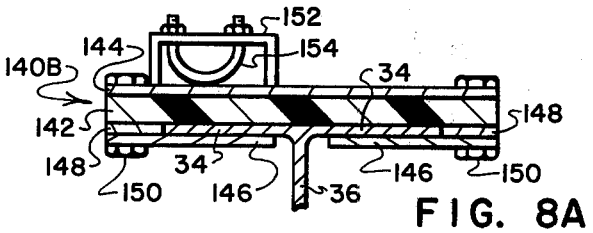
FIG. 8A is a sectional view taken along a plane indicated by a line 8A—8A in FIG. 7A.

In order to guide the movement of the actuating rods 102 during their travel back and forth along the braces 32, slide blocks 140A–140D are provided. The slide blocks 140A, 140D are secured to the flanges 34 along the underside of the braces 32, and the slide blocks 140B, 140C are secured to the flanges 34 along the upper surface of the braces 32. Referring particularly to FIGS. 7A and 8A, each of the upper slide blocks 140B, 140C includes a rectangular runner 142 formed of relatively friction-free material such as nylon. One surface of the block 142 engages the upper surface of the flanges 34 and permits the slide blocks 140B, 140C to move with respect to the braces 32 with relatively little friction. The blocks 142 are held in place against the flanges 34 by means of a guide plate 144 and back plates 146 disposed on either side of the web 36. Spacers 148 are disposed between the plates 146 and the runner 142 along the sides of the flanges 34 in order to provide a proper spacing between the runner 142 and the plates 146 as well as to constrain sideways movement of the blocks 140B, 140C with respect to the braces 32. The assembly is held in place by means of bolted fasteners 150 which extend completely through the runner 142, the plates 144, 146, and the spacers 148. A bracket 152 is secured atop the guide plate 144 and defines a passage within which a portion of a U-bolt 154 is disposed. Referring to FIGS. 1–3, the U-bolts 154 tightly engage the rods 102 and prevent relative motion between the rods 102 and the slide blocks 140B, 140C.

Figure 7B:
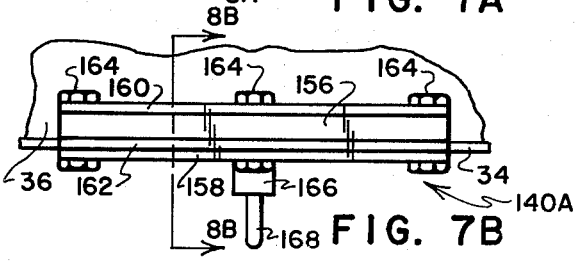
FIG. 7B is an enlarged view of a lower slide block as illustrated in FIG. 3.
Figure 8B:
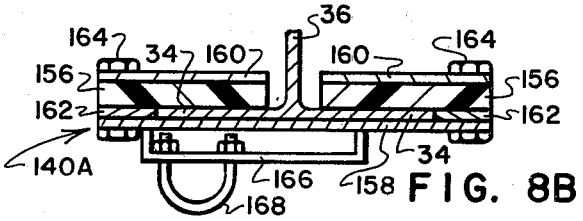
FIG. 8B is a sectional view taken along a plane indicated by line 8B—8B in FIG. 7B.

The construction of the slide blocks 140A, 140D is similar to the construction of the slide blocks 140B, 140C except that certain of the parts are reversed because the slide blocks 140A, 140B are on the underside of the braces 32, rather than on the upper side of the braces 32. Referring to FIGS. 7B and 8B, the slide blocks 140A, 140D include spaced runners 156 disposed on either side of the web 36 and resting atop the upper surface of the lower flanges 34. Like the runner 142, the runners 156 are formed of a relatively friction-free material such as nylon. In a manner analogous to that of the slide blocks 142B, 142C, the runners 156 are held in proper position against the flanges 34 by means of a guide plate 158, back plates 160, spacers 162, and bolted fasteners 164. Supports 166 extend from the guide plate 158 and provide a place of attachment for U-bolts 168. Referring particularly to FIGS. 1 and 3, the U-bolts 168 tightly engage the rods 102 to prevent relative motion between the rods 102 and the slide blocks 140A, 140D.

The construction of the pulleys 94, 96, 98, permits the direction of force applied to the chains 92A–92D to be changed in a particularly effective manner. The pulleys 94, 96 are the same size, while the pulley 98 is smaller. Common reference numerals identifying components of the pulleys 94, 96, 98 will be used where appropriate to identify components performing substantially identical functions. Each of the pulleys 94, 96, includes a first pair of disc-like plates 170 having openings formed at their center. A second pair of disk-like plates 172, smaller in diameter than the first pair of plates 170, is compressed between the plates 170. The second pair of plates 172 also include an opening at their center. A third disc-like plate 174 also includes an opening at its center and is compressed, in use, between the second pair of plates 172.

To assemble the pulleys 94, 96, the openings in the plates 170, 172, 174 are aligned and a bushing 176 is inserted through the aligned openings. Pins (not shown) are inserted through aligned openings in the plates 170, 172, 174 are welded to prevent separation and relative rotational movement between the plates 170, 172, 174. Thereafter, a shaft 178 is inserted through the bushing 176 to project outwardly of the bushing 176 on either side. With respect to the pulleys 98, a second bushing 177, larger in diameter than the bushing 176, is fitted over the bushing 176 and rings 179 are secured to the bushing 177. The rings 179 are approximately the same diameter as the second pair of plates 172.

Each shaft 178 extends at one end through openings (not shown) formed in the webs 24 of the posts 20A–20D. The other end of each shaft 178 is supported by a pulley shaft support plate 180A–180D. The plates 180A, 180D support the shaft 178 associated with the pulleys 94, while the plates 180B, 180C support the shafts 178 associated with the pulleys 96, 98. As best seen in FIG. 3, the pulley shaft support plates 180A–180D are secured to the flanges 22 of the posts 20A–20D. Openings (not shown) are formed in the flanges 22 in order to permit the chains 92A–92D to pass through the flanges to be reeved about the pulleys 94, 96, 98 to extend vertically within the channels 26.

Figure 5:
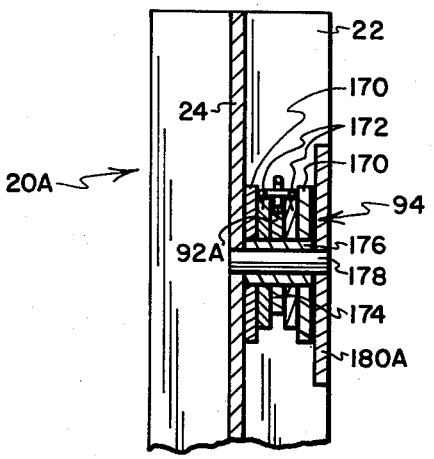
FIG. 5 is a view taken along a plane indicated by line 5—5 in FIG. 3.
Figure 6:
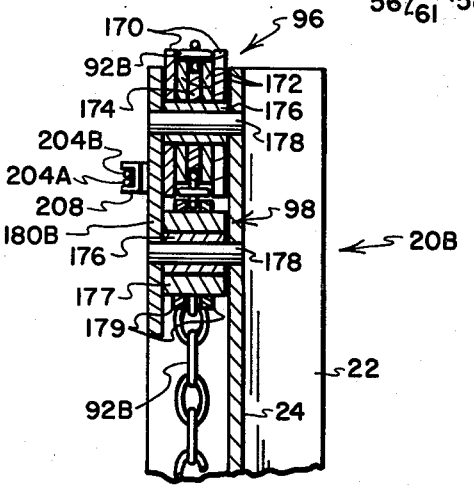
FIG. 6 is a view taken along a plane indicated by line 6—6 in FIG. 3.

The particular construction of the pulleys 94, 96, 98 permits chains 92A–92D to experience relatively little stress during a lifting operation. Referring particularly to FIGS. 5 and 6, the thickness and diameter of the plates 172, 174 and the bushing 177 and the rings 179 is selected such that every other link of the chain 92A–92D coming in contact with one of the pulleys 94, 96, 98 engages the outer surface of the second pair of plates 172 or the rings 179. Moreover, the remaining links of the chain 92A–92D in contact with the pulleys 94, 96, 98 are oriented perpendicular to the first-mentioned links and come in contact with the outer surface of the third plate 174 or the bushing 177. Not only does this structure permit the pulleys 94, 96, 98 to be manufactured inexpensively, but it also provides that the chains 92A–92D cannot become twisted during a lifting operation. Undue stresses also are avoided because a maximum number of chain links come in contact with the pulleys 94, 96, 98, thereby more or less uniformly distributing the load among the links. Consequently, the life of the chains 92A–92D is extended greatly, and the chances of a chain breaking and endangering nearby personnel is minimized greatly.

Even though the hoist 10 according to the invention is exceedingly strong, additional safety measures are included. Certain of the flanges 22 of the posts 20A–20D include openings 182 through which pins 184 can be fitted. Referring to particularly to FIG. 3, the pins 182 can be inserted into the openings 182 after the lifting frame 40 has been raised to a desired height. The openings in the flanges 22 are selected such that the lifting frame 40 can fall only a small distance if a chain should break or if the force being applied to the chains 92A–92D by the hydraulic cylinders 100 should diminish for some reason.

The invention also includes an actuating system for raising and lowering the lifting frame 40. Referring particularly to FIGS. 1 and 2, the actuating system includes an electric motor 190 which drives a hydraulic pump 192. A reservoir 194 is disposed atop a shelf 196 fitted to the post 20C at or near the upper end of post 20C. The shelf 196 is securely held in place by braces 198. A switch 200 controls operation of the motor 190, and a valve 202 controls the output of the pump 192. High pressure supply lines 204A–204D extend from the pump 192 to inlet fittings 206 included as part of the hydraulic cylinders 100. The line 204A is connected the drive means 90A, the line 204B is connected to the drive means 90B, and so forth. A portion of the supply lines 204A–204D are carried and protected by the braces 32. A frame 208 is secured to the shelf 196 and to the post 20B near the upper end of the post 20B in order to provide support and protection for that portion of the lines 204A, 204B extending from the pump 192 across the front of the hoist 10. A brace 210 connected at one end to the frame 208 and at the other end to the post 20B helps support the frame 208. It will be appreciated that the arrangement of hydraulic lines 204A–204D is particularly advantageous because the lines are well protected against damage. Accordingly, there is little likelihood that the lines 204A–204D will fail due to accident.

Operation

It will be assumed that the lifting frame 40 is in that position illustrated in FIG. 1 and that a vehicle has just been driven onto the runways 62. Upon energization of the motor 190 and subsequent activation of the pump 192 and its associated valve 202, hydraulic fluid under high pressure will be supplied to the drive means 90A–90D through the hydraulic lines 204A–204D. The actuating rods 102 will be retracted, thereby moving the chains 92A–92D with respect to the pulleys 94, 96, 98. In turn, the lifting frame 40 with the vehicle in place will be lifted. After the vehicle has been lifted to a desired height, the safety pins 184 can be inserted in the openings 182 in the flanges 22 and the vehicle can be serviced. After the vehicle has been serviced and the pins 184 have been removed, the lifting frame 40 can be lowered by appropriate control of the valve 202.

Because the braces 32 are located near the upper end of the posts 20A–20D, because the braces 32 are parallel to the actuating rods 102, and because the braces 32 are positioned close to where the shafts 178 are located, substantially all horizontal forces acting on the posts 20A–20D are imposed on the braces 32. Because the ends of the braces 32 are securely attached to the posts 20A–20D and because the braces 32 are loaded in compression rather than in tension, the hoist 10 is quite stable. The invention makes substantial use of relatively inexpensive H-beam and I-beam construction and the particular construction of the crosspieces 42, the runways 62, and the sliding relationship between the crosspieces 42 and the posts 20A–20D produces a strong, efficient structure. The construction of the pulleys 94, 96, 98 insures that the chains 92A–92D are stressed to a minimum, and the sliding blocks 140A–140D contribute to the strength and efficiency of the lifting mechanism.

Although the invention has been described in its preferred form with a certain degree of particularity, it will be understood that the present disclosure of the preferred embodiment has been made only by way of example and that numerous changes in the details of construction and the combination and arrangement of parts may be resorted to without departing from the true spirit and scope of the invention as hereinafter claimed. It is intended that the patent shall cover by suitable expression in the appended claims, whatever features of patentable novelty exist in the invention disclosed.

What is claimed is:

1. A hoist for lifting vehicles such as automobiles, trucks, and so forth, comprising:

at least four vertically extending posts, the posts defining a quadrilateral, one post being placed at each corner of the quadrilateral;

a lifting frame having portions positioned within the quadrilateral, the lifting frame being engageable with portions of a vehicle so as to raise and lower the vehicle, the lifting frame being vertically slidably connected to each of the posts;

a first brace extending between and connected to a given pair of posts, a second brace extending between and connected to the other pair of posts, the braces, when viewed from above, being parallel with each other and lying generally along the boundary of the quadrilateral defined by the posts, the braces being connected to the posts toward the upper end of the posts;

a plurality of drive means for raising and lowering the lifting frame, a separate drive means being provided for each corner of the lifting frame and being connected to each corner of the frame by means of a different one of first, second, third and fourth flexible connections two drive means being secured to the first brace and two driving means being secured to the second brace, and said flexible connections being movably supported by corresponding one of said vertically extending posts near the top of the corresponding post between the two ends of the flexible connection.

2. The hoist of claim 1, wherein the flexible connection comprises a chain.

3. The hoist of claim 1, wherein:

each drive means comprises a hydraulic cylinder having an extensible actuating rod; and, each flexible connection comprises a chain connected at one end to the rod and connected at the other end to the frame, the chain passing over a pulley located at or near the upper end of each post.

4. The hoist of claim 3, wherein each pulley comprises a plurality of cylindrical, disc-like plates secured to each other, the centers of the plates being aligned along a common axis and including an opening through which a shaft extends, the diameter of the outermost plates being larger than the diameter of next adjacent middle plates, and the diameter of the middle plates being larger than the diameter of a center plate.

5. The hoist of claim 3, wherein the braces lie in a horizontal plane and the actuating rods are movable in a horizontal plane.

6. The hoist of claim 1, wherein the frame comprises:

a pair of crosspieces, each crosspiece extending between, and in engagement with, a pair of posts, the crosspieces, when viewed from above, being placed parallel to each other and located at or near the perimeter of the quadrilateral defined by the posts; and, a pair of runways positioned substantially perpendicular to the crosspieces, the runways being in contact with the crosspieces but not the drive means the connection between the drive means and the lifting frame occurring at or near the ends of the crosspieces.

7. The hoist of claim 6, wherein a sliding connection between the crosspieces and the posts is provided, the sliding connection comprising flanges extending from the posts, the crosspieces extending within the confines of the flanges, and relatively friction-free surfaces included as part of the crosspieces, the friction-free surfaces engageable with the flanges to constrain the crosspieces and yet permit relatively friction-free vertical movement of the crosspieces along the posts.

8. The hoist of claim 7, wherein the flanges are connected by webs and friction-free surfaces included as part of the crosspieces engage the webs to constrain lateral movement of the crosspieces.

9. The hoist of claim 1, wherein each post includes a projecting portion against which a portion of the frame comes in contact during a lifting operation, the projecting portion including a portion to which a stop can be secured when the frame is in the lifted position, the stop serving to prevent vertically downward movement of the frame relative to the posts.

10. The hoist of claim 1, wherein the quadrilateral is in the form of a rectangle having longer and shorter sides, the braces being parallel with the longer sides of the rectangle.

11. A hoist for lifting vehicles such as automobiles, trucks, and so forth, comprising:

at least four vertically extending posts, the posts defining a quadrilateral, one post being placed at each corner of the quadrilateral;

a lifting frame having portions positioned within the quadrilateral, the lifting frame being engageable with portions of a vehicle so as to raise and lower the vehicle, the lifting frame being vertically slidably connected to each of the posts;

a first brace extending between and connected to a given pair of posts, a second brace extending between and connected to the other pair of posts, the braces, when viewed from above, being parallel with each other and lying generally along the boundary of the quadrilateral defined by the posts, the braces being connected to the posts toward the upper end of the posts;

a plurality of drive means for raising and lowering the lifting frame, a separate drive means being provided for each corner of the lifting frame and being connected to each corner of the frame by means of a flexible connection, two drive means being secured to the first brace and two driving means being secured to the second brace;

each drive means comprising a hydraulic cylinder having an extensible actuating rod;

each flexible connection comprising a chain connected at one end to the rod and connected at the other end to the frame, the chain passing over a pulley located at or near the upper end of each post;

a plurality of sliding blocks connected to the braces, one sliding block being provided for each hydraulic cylinder, the blocks being slidable along the braces and carrying the end of the actuating rods and the connection with the chains.

12. A relatively inexpensive, rapidly constructed hoist for lifting vehicles such as automobiles, trucks, and so forth, comprising:

vertically extending posts, each post being placed at the corner of an area in the shape of a quadrilateral, each post being in the form of an H-beam, the flanges of the H-beam defining channels;

a lifting frame disposed largely within the area defined by the quadrilateral, the lifting frame including a pair of crosspieces formed of I-beams, the crosspieces when viewed from above being parallel with each other and extending between and coming in contact with channels of separate pairs of posts, the lifting frame also including a pair of generally parallel runways formed of I-beams, the runways resting atop and being carried by the crosspieces, the runways when viewed from above being substantially perpendicular to the crosspieces;

a pair of braces connecting the posts, the braces being in the form of H-beams, the braces being secured to the posts on the outer surface of the flanges defining the channels;

a lifting mechanism, the lifting mechanism being connected to the corners of the frame whereby, upon actuation of the lifting mechanism, the frame is raised and lowered as desired;

the lifting mechanism including a pair of drive means secured to each brace, the drive means being connected to separate ends of the crosspieces, the connections being made by a flexible connection extending from the drive means to and around a pulley secured at or near the upper end of each post.

13. The hoist of claim 12, wherein the braces, when viewed from above, are positioned parallel to the runways.

14. The hoist of claim 12, wherein the lifting frame further includes plates secured to the crosspieces and a plurality of tabs secured to both the plates and the crosspieces, the tabs projecting outwardly of the crosspieces and being engageable with the runways, the tabs serving to limit lateral movement of the runways along the crosspieces and to brace the crosspieces.

15. The hoist of claim 12, wherein: the crosspieces each are formed from a pair of I-beams disposed side-by-side and secured to each other, the I-beams being positioned with their flanges lying in horizontal planes, the I-beams having a rectangular plate conforming generally to the shape of the assembled I-beams secured to the bottom of the I-beams, the I-beams also including blocks of relatively friction-free material secured at either end, the friction-free material adapted for sliding, vertical engagement with the channels included as part of the posts;

the runways each include a pair of H-beams disposed side-by-side, the flanges of the H-beams lying in horizontal planes, a cover plate conforming generally to the shape of the H-beams being secured atop the H-beams, the cover plate extending beyond the ends of the I-beams for a distance approximately the width of the crosspieces; and, a ramp section secured to one end of each runway and a vertically extending stop member secured to the other end of each runway, the ramp members serving to provide a smooth transition between the ground upon which the lifting frame rests and the upper surface of the runway and the stop members serving to prevent a vehicle from driving off the end of the runways.

16. An inexpensive, rapidly assembled pulley for efficiently changing the direction of force applied by a chain, comprising:

a first pair of disc-like plates, each of the first pair of plates having an opening at its center;

a second pair of disc-like plates, each plate having an outer diameter smaller than the outer diameter of the first pair of plates, each of the second pair of plates also having an opening at its center, the second pair of plates, in use, having their openings positioned coaxially with respect to the openings in the first pair of plates, the second pair of plates being compressed between the first pair of plates; and, a third disc-like plate, the third plate including an opening at its center, the third plate having an outer diameter smaller than the outer diameter of the second pair of plates, the third plate being compressed, in use, between the second pair of plates and having its central opening positioned coaxially with respect to the openings in the second pair of plates.

17. The pulley of claim 16, wherein the thickness and diameter of the plates is such that every other link of a chain in contact with the pulley is supported on the outer diameter of the second pair of plates, and the width of the third plate is such that the remaining links of the chain in contact with the pulley engage the outer diameter of the third plate.

18. A hoist for lifting vehicles such as automobiles, trucks, and so forth, comprising:

four vertically extending posts, the posts defining a rectangle with one post being placed at each corner of the rectangle, the posts being in the form of H-beams having channel-defining flanges;

a lifting frame disposed largely within the area defined by the rectangle, the lifting frame including a pair of crosspieces formed of I-beams, the crosspieces when viewed from above being parallel with each other and extending between and coming in contact with channels of separate pairs of posts, the lifting frame also including a pair of generally parallel runways formed of H-beams, the runways resting atop and being carried by the crosspieces, the runways when viewed from above being substantially perpendicular to the crosspieces;

a pair of braces connecting the posts, the braces being in the form of H-beams, the braces being secured to the posts on the outer surface of the flanges defining the channels, the braces being parallel with the longer sides of the rectangle; and, a lifting mechanism, the lifting mechanism being connected to the ends of the crosspieces whereby, upon actuation of the lifting mechanism, the frame is raised and lowered as desired, the lifting mechanism including:

hydraulic cylinders having extensible actuating rods, two hydraulic cylinders being secured to each brace and connected to a different crosspiece;

a flexible connection between each actuating rod and an end of a crosspiece, the flexible connection being in the form of a chain passing over a pulley, the pulley being located at or near the upper end of a post; and, a plurality of sliding blocks connected to the braces, one sliding block being provided for each hydraulic cylinder, the blocks being slidable along the braces and carrying the ends of the actuating rods and the connection with the chains.

* * * * *

UNITED STATES PATENT AND TRADEMARK OFFICE

CERTIFICATE OF CORRECTION

PATENT NO. : 4,300,659

DATED : November 17, 1981

INVENTOR(S) : Thomas R. Silverstrand

It is certified that error appears in the above-identified patent and that said Letters Patent are hereby corrected as shown below:

Column 1, line 22, after "being", delete "used";

Column 4, line 38, after "ends of", add --each--;

Column 4, line 63, after "posts 20", add --A--;

Column 5, line 28, change "at the end" to --at that end--;

Column 6, line 1, change "flange" to --flanges--;

Column 7, line 22, change "disk" to --disc--;

Column 7, line 33, change "are" to --and--;

Column 7, line 53, change "to be reeved" to --and be reeved--;

Column 8, line 14, after "referring", delete "to";

Column 8, line 33, after "connected", add --to--.

UNITED STATES PATENT AND TRADEMARK OFFICE

CERTIFICATE OF CORRECTION

PATENT NO. : 4,300,659

DATED : November 17, 1981

INVENTOR(S) : Thomas R. Silverstrand

It is certified that error appears in the above-identified patent and that said Letters Patent are hereby corrected as shown below:

IN THE CLAIMS:

Column 9, line 53, after "connections" add --,--;

Column 9, line 47, after "posts;" add --and--;

Column 10, line 22, after "means" (first occurrence), add --,--.

Signed and Sealed this

*Fifteenth* Day of *June 1982*

[SEAL]

*Attest:*

GERALD J. MOSSINGHOFF

*Attesting Officer* *Commissioner of Patents and Trademarks*